US005368252A

United States Patent [19]

Biagiotti

[11] Patent Number: 5,368,252

[45] Date of Patent: Nov. 29, 1994

[54] APPARATUS AND METHOD FOR WINDING ROLLS OF WEB MATERIAL WITH SEVERING OF WEB BY ROLL ACCELERATION

[75] Inventor: Guglielmo Biagiotti, Capannari, Italy

[73] Assignee: Fabio Perini S.p.A., Lucca, Italy

[21] Appl. No.: 911,005

[22] Filed: Jul. 9, 1992

[30] Foreign Application Priority Data

Jul. 16, 1991 [IT] Italy ..... FI/91/A-178

[51] Int. Cl.[5] ..... B65H 19/30

[52] U.S. Cl. ..... 242/521; 242/526.1; 242/542.1; 242/542.2

[58] Field of Search ..... 242/56 R, 66, 67.1 R, 242/67.5, 56.8, 521, 526.1, 542.1, 542.2

[56] References Cited

U.S. PATENT DOCUMENTS 4,783,015 11/1988 Shimizu ..... 242/66 X
4,828,195 5/1989 Hertel et al. ..... 242/66
5,137,225 8/1992 Biagiotti ..... 242/56 R X

FOREIGN PATENT DOCUMENTS 934619 8/1963 United Kingdom ..... 242/66
1435525 5/1976 United Kingdom ..... 242/66

*Primary Examiner*—John M. Jillions
*Attorney, Agent, or Firm*—Francis J. Bouda

[57] ABSTRACT

A machine and process for the production of rolls or logs of web material wherein web material is fed through a nip (5) formed between two winding rollers (1, 3) and wound around a core to form a roll or log (R) within a winding space defined by said two winding rollers and by a third roller. At the end of the winding of a log, the third roller (7) is temporarily accelerated to locally increase the speed of the web and to put the web material in tension between the third roller and one of said winding rollers. The tearing of the web material takes place because at that moment the incoming web is pinched between a new core and the one winding roller on which the material is driven. Transverse perforations can be made in the web by a perforating group. The third roller speed change is controlled by an epicyclic gear train and a controlling motor. The cyclical speed change of the third roller is done in synchronism with the perforating group.

10 Claims, 3 Drawing Sheets

Figure 1:
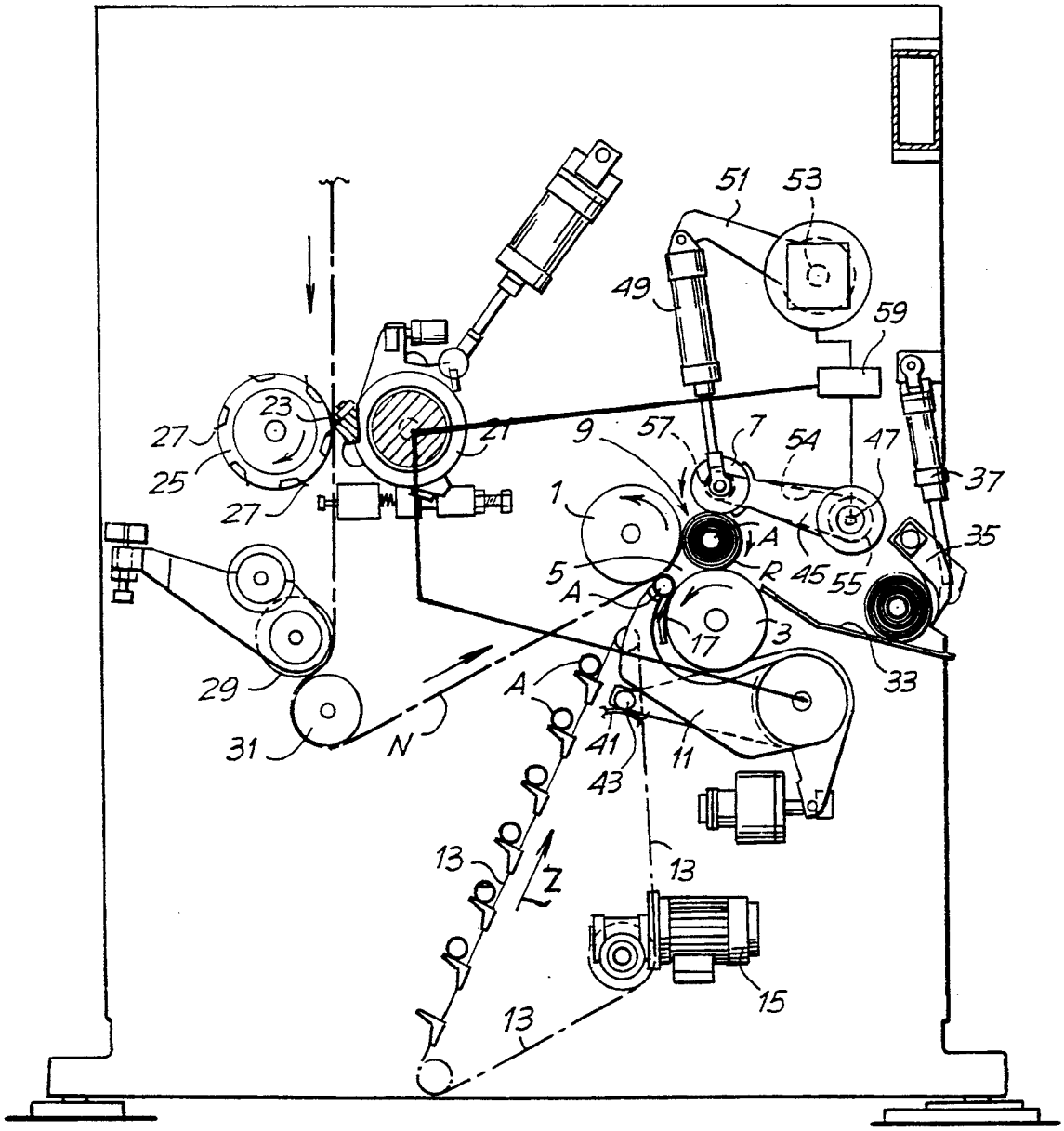

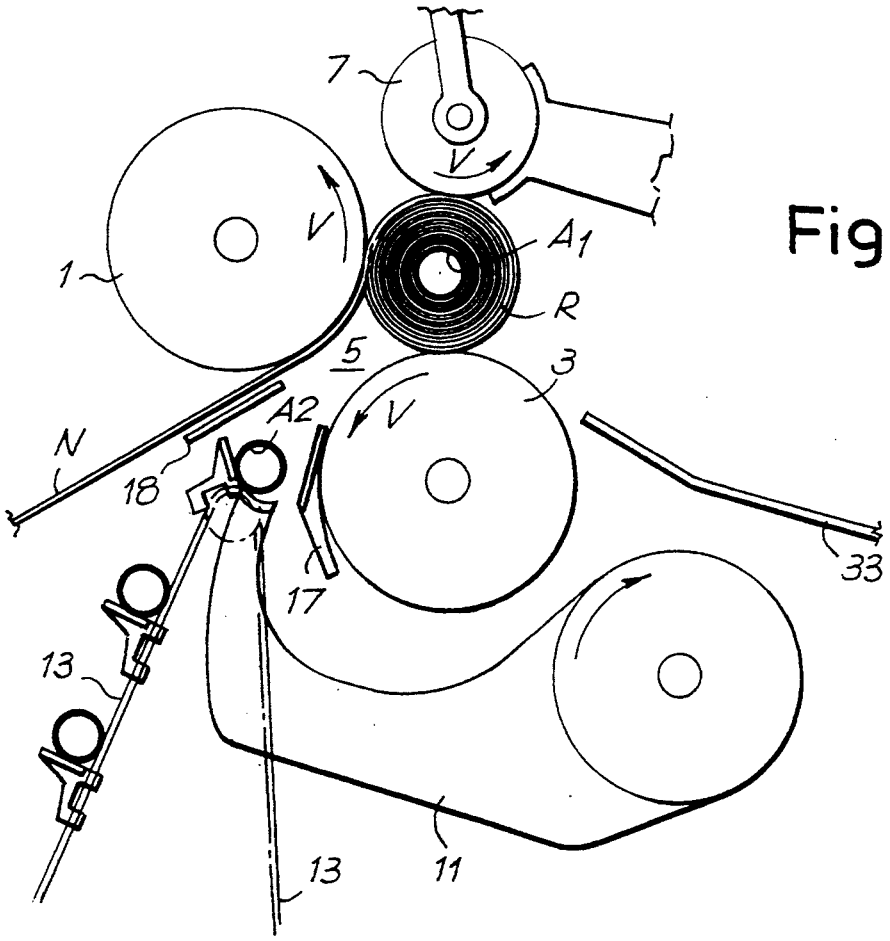
Fig. 2
Fig. 3
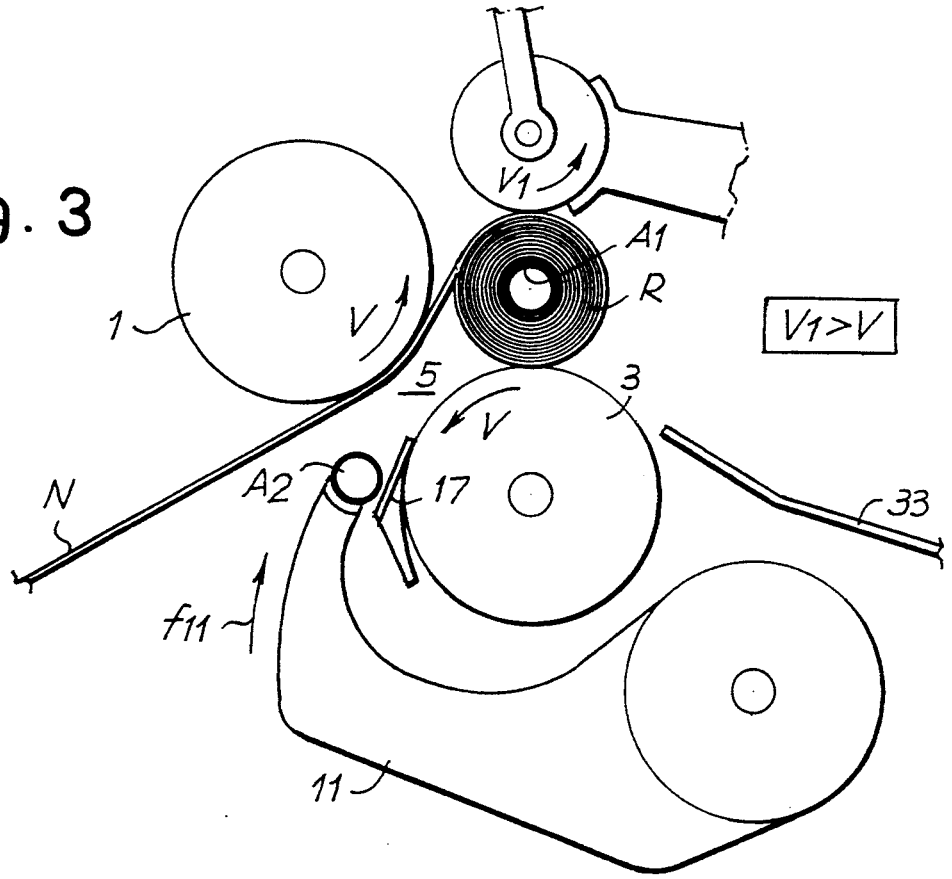

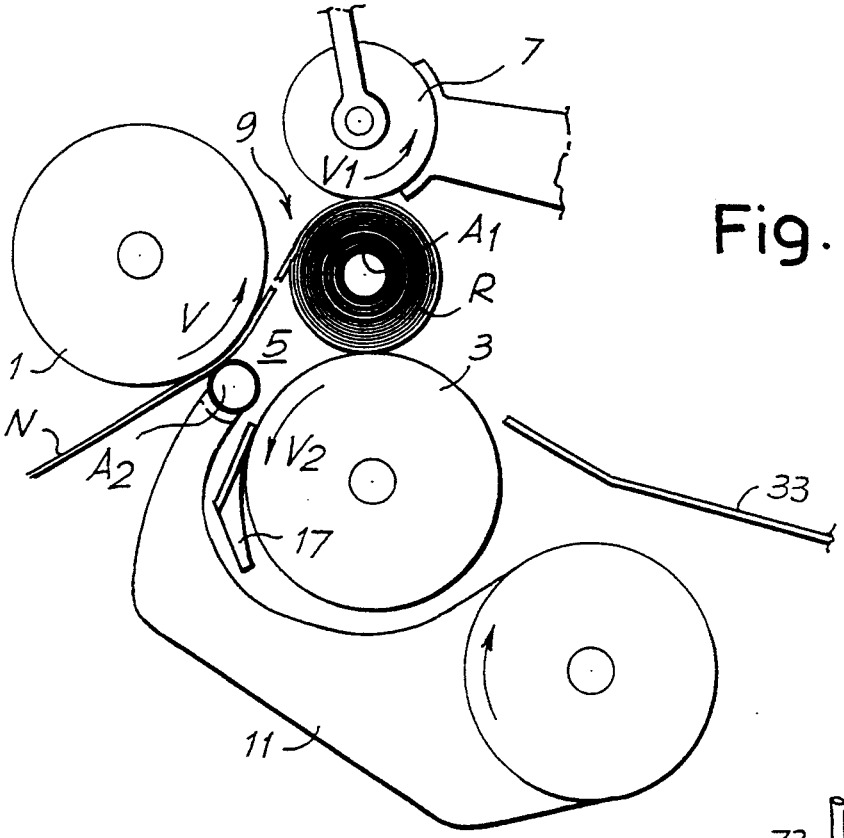
Fig. 4
Fig. 5
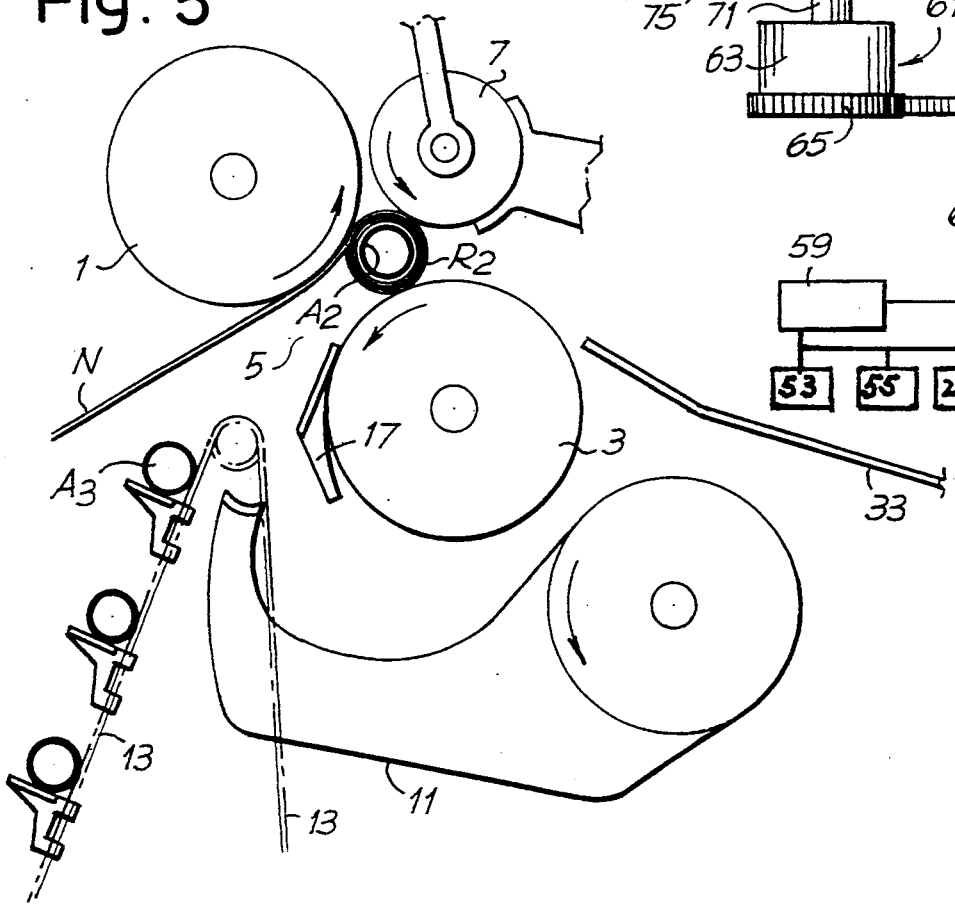
Fig. 6
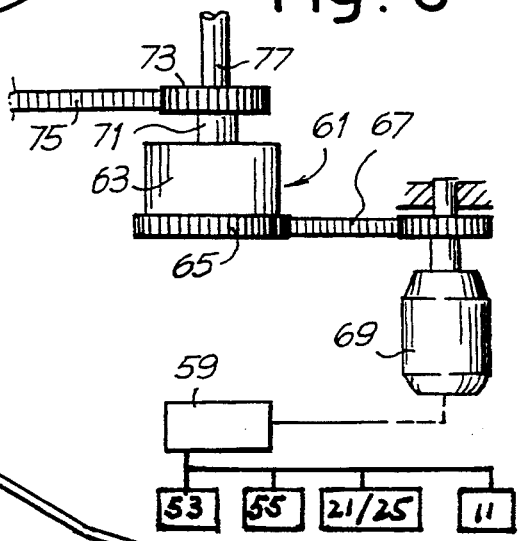

APPARATUS AND METHOD FOR WINDING ROLLS OF WEB MATERIAL WITH SEVERING OF WEB BY ROLL ACCELERATION

DESCRIPTION

The invention refers to a method for the formation of rolls or logs of web material, in which the web material is fed through a nip formed by two winding rollers and wound up around a core to form a roll or log within a winding space defined by said two winding rollers and by a third roller, said web material being made to advance around one of the two winding rollers. At the end of the winding of a log, a new core is inserted into the nip defined by the two winding rollers, the web material is torn in a region between the completed log and the new core, and the completed log is moved away from the winding space.

A similar winding method is described in patent GB-B-2 105 688, wherein, according to this known method, when a log in the process of being formed between a first and a second winding roller and a third roller has been completed (for example, it has reached the desired diameter or length of reeled material), the second winding roller is slowed down while a core is inserted an insertion means into a nip defined by the two winding rollers. The slowing down of the second winding roller results in the advancement of the core into the nip, and the subsequent removal of the formed log by the first winding roller.

When the log has moved away by a certain extent from the nip formed by the two winding rollers, the third roller is temporarily slowed down to bring its peripheral speed to the same as that of the second winding roller, so that the completed log remains temporarily at a preset position with respect to the three rollers. In this position (between the completed log and a new core inserted into the nip where it presses the web against the first winding roller), a free length of web material is formed.

A subsequent acceleration of the third roller causes the web material to tear between the region of contact with the new core and the region of tangency to the completed log. The differences between the peripheral speeds of the two winding rollers and the third roller will thus cause the discharge of the finished leg and completion of the core insertion into the winding space. Afterwards, the three rollers are brought to the same peripheral speed to carry out the winding of the next log on the just inserted new core. The cycle is repeated for each successively formed log.

The drawback of the machine and method described in GB-A-2105688 is that the tearing of the web material takes place within a relatively long stretch of free web material and, consequently, it may cause an irregular tearing of the web material. Moreover, the tearing may occur at any position along the free stretch of web material, and this may result in an inconstant length of material being wound on successive logs.

EP-A-0408526 discloses a different winding method and a different machine for the production of logs of web material reeled around a core. This machine differs from that of patent GB-B-2105688 in the way the web material is torn off at the end of the winding of a log. This known rewinding machine provides for a fixed surface, tangent to the first winding roller, on which the web material (fed into the nip between the two winding rollers) is made to slide for the formation of the log.

Upon completion of a log, an insertion means inserts a new core into the nip defined by the two winding rollers. During the insertion stage, the core presses the web material between it and the fixed surface.

This causes an instantaneous slowing down of the web material, so that the speed with which it is fed into the nip is reduced with respect to the peripheral speed of the web wound onto the log which is at that time positioned between the two winding rollers and the third roller. Such speed difference causes a tearing of the web material. The subsequent slowing down of the second winding roller completes the insertion of the core into the winding space and discharges the log just formed.

Since the web material is temporarily slowed down at the entry to the nip when a log has been completed, provision must be made for means to keep the incoming web material in tension upstream (i.e., in front) of the nip, to control the surplus web material accumulating as a result of the temporary slowing down of the said material during the insertion of a new core, as well as to recover such surplus web material when the winding of the next log begins. To this end, suction means are provided wherein a loop of web material is formed which will subsequently be recovered by an acceleration of the first winding roller.

The object of the present invention is to provide a method as above described which makes it possible to tear the web material, upon completion of a log, with greater accuracy and without need for the recovery of surplus of web material caused by the slowing down of said material.

The method according to the present invention is characterized in that, at the end of the winding of a log, the third roller which defines the winding space is temporarily accelerated to such a degree as to put in tension the web material in the area intermediate the contact between the third roller and one of the two winding rollers, and to locally accelerate said web material.

In practice, the acceleration of the third roller, prior to the pinching of the web in the nip, will cause the web material to increase its linear speed and to slip over the surface of the winding roller around which it is being driven, thereby undergoing a tensioning. The subsequent contact of the core with the web material and the pinching of the latter between the core and the winding roller, (the latter rotating with a peripheral speed slightly lower than the temporary linear speed of the web material), causes the tearing of the web material in the short length between the area of contact of the core with the web material and the area of tangency with the completed log.

Further advantageous features of the method according to the invention are set forth in the appended claims.

The invention further relates to a rewinding machine for the production of rolls or logs of web material. It comprises two winding rollers defining a nip into which the cores for the formation of the logs are inserted and the web material to be wound passes; a third roller defining with the two winding rollers a winding space for the log; an insertion means to insert the cores within said nip; and means to cyclically change the peripheral speed of said third roller.

To carry out the method according to the invention, the rewinding machine is characterized in that the means for cyclically varying the peripheral speed of said third roller are programmed in such a way as to cause, upon completion of a log, a tensioning and a local acceleration of the web material in the region wherein it is driven around one of said winding rollers prior to the insertion of a new core into said nip.

Further advantageous embodiments of the machine according to the invention are set forth in the appended claims.

The invention will be better understood by following the description and the attached drawings which shows a practical, not limiting, exemplification of the invention.

In the drawings, wherein like reference characters indicate like parts:

FIG. 1 shows a general diagram of the rewinding machine according to the invention.

FIGS. 2 to 5 schematically show the steps relevant to the end of the winding of a log, the replacement of a completed log with a new core, and the beginning of the winding on said core.

FIG. 6 shows a kinematic diagram of a feasible embodiment of the means for varying the speed of the third roller.

Referring first to FIG. 1, numeral 1 denotes a first winding roller and numeral 3 a second winding roller which define a nip 5 into which the cores A are inserted. On the cores a web material N is wound, the latter being typically a paper material for the formation of rolls of toilet paper, kitchen towels wipes or the like. Arranged above the winding rollers 1 and 3 is a third roller 7 which defines, together with the winding rollers 1 and 3, a winding space 9 within which the logs R are formed by winding web material over respective cores A.

Arranged below the winding roller 3 is an insertion means 11 which picks up the cores from a conveyor 13 powered by a motor 15, and inserts them into the nip 5. Arranged between the conveyor 13 and the second winding roller 3 is a fixed surface 17 which prevents contact of core A (in the process of being inserted) with the second winding roller 3 until said core A contacts the web material N thereby causing the breaking of the web material.

The cores A (which may be 1¾ inches in diameter and 130 inches long) are fed by the conveyor 13 in the direction of the arrow Z. A strip of glue is applied on the cores by a device (not shown) of the type, for example, described in U.S. Pat. No. 4,931,130.

Before arriving at the winding region the web material N is perforated along tear lines which will be parallel to the axis of the core. The perforations are achieved by means of a fixed cylinder 21 carrying a blade 23, and a rotary cylinder 25 carrying a plurality of counterblades 27. The web material N is driven out, downstream of the perforating rollers 21, 25, by two cylinders 29 and 31 which define its path upstream of the first winding roller 1. The path of the web material from cylinder to the first winding roller 1 is such that the amount of web material N contacting (i.e. lying upon) the first winding roller 1 traverses a very small area of the winding roller 1. This is typically less than 90°, to allow the web material to slip on the first winding roller for the purposes to be indicated hereinafter.

Arranged downstream of the second winding roller 3 is a discharge plane 33 onto which the logs R coming from the winding region 9 are unloaded. The finished logs are discharged therefrom one at a time onto a conveyor means (not shown) by a distributor 35 controlled by a cylinder-piston system 37.

The oscillation motion of the insertion means 11 to insert the core A into the nip 5, may be controlled by a system comprising a cam 41 and a rocker 43 connected to the insertion means 11. Alternatively, the actuating of the insertion means 11 may be by means of a motor controlled by a central processing unit.

The third roller 7 is supported by an arm 45 which oscillates about a fulcrum pin 47, and which is moved by an arm 51, with the interposition of a cylinder-piston system 49 acting as a limiter for limiting the forces applied to the roller 7, and by a servomotor 53 controlled by a central processing unit 59. The system allows the roller 7 to be moved towards and away from the winding rollers 1, 3, to allow the log R to increase in diameter during formation thereof within the winding space 9. The rotary motion of the roller 7 is obtained via a belt 54, shown in dotted line, which is moved around two pulleys 55 and 57, respectively.

To allow for a variation of the rotary speed of roller 7, a system may be provided comprising a differential epicyclic gearing and a correcting motor controlled by central unit 59. FIG. 6 is a schematic representation of a kinematic arrangement for the variation of the rotary speed of roller 7. To this end, a differential epicyclic gearing 61 is provided, which has a gears holder 63 fixed to a pulley 65 having a belt 67 thereon. The belt 67 is driven by a correcting motor 69 controlled by the unit 59. Keyed on a first axle 71 of the epicyclic gearing 61 is a pulley 73 on which a belt 75 is driven. The belt 75 is driven by the main shaft of the rewinding machine (not shown). Therefore, the axle 71 rotates at a constant speed during the whole winding cycle. A second axle 77 of the epicyclic gearing 61 rotates at a speed proportional to that of shaft 71 when the correcting motor 69 is at a standstill. The ratio between the rotary speeds of the two axles is determined by the internal ratio of the gearing. Vice versa, when the motor 69 controlled by the unit 59 is driven into rotation at a pre-determined speed, the axle 77 of the epicyclic gearing 61 will have a modified speed with respect to the normal transmission ratio between the axles 71, 77, as defined by the internal ratio of the epicyclic gearing 61. Keyed on the axle 77 is the pulley 55 which transmits the motion to belt 54 and thus to roller 7.

Accordingly, upon the command given by the central unit 59, by means of motor 69, it is possible to vary the speed of roller 7 with respect to that of the machine's main shaft, from which the motion of winding rollers 1 and 3 and of the perforating roller 25 are also taken.

With reference to the schematic FIGS. 2 to 5, FIG. 2 shows the end of the winding phase of a log R onto a core A1, prior to the insertion into the nip 5 of a next core A2. In this stage, the peripheral speeds of the winding rollers 1 and 3 and of the third roller 7 are substantially equal to each other and to the linear advancement speed V of the web material N. In actual practice, the peripheral speeds of rollers 1, 3 and 7 may be slightly different to each other and to the advancement speed V of the web material N. Any such speed difference (which is set at the beginning of the production) is limited to values which provide proper tensioning of the web material N, without tearing the web, in order to attain desired compactness of log R.

When the log R has been completed, i.e., when a pre-determined diameter of log R or length or weight of the web material being wound on the core A1 has been reached, the roller 7 is accelerated to such a degree as to have its peripheral speed equal to V1 (see FIG. 3)

which is higher than the advancement speed V of the web material N. At this stage, the web material upstream of the log R is put in tension and accelerated locally whereby it tends to slip on the surface of the first winding roller 1 which continues to move at the constant speed V. The tension in the web material N at this stage extends over the length of web material between the cylinder 31 and the winding roller 1. This length is chosen sufficiently long to avoid an undesirable rupture of the material N before the new core is inserted into the nip 5.

During this phase, the insertion means 11 removes a core A2 from the conveyor 13 and advances it close to the nip 5 defined between the two winding rollers 1 and 3. The further oscillation of the insertion means 11 in direction of the arrow f11 (FIG. 3) brings the core A2 in contact with that portion of web material N lying on the winding roller 1. This is shown in FIG. 4. In this way, the web material N is pinched between the core A2 and the surface of the first winding roller 1.

Since the web material N has been put under tension, and its linear speed where it contacts the winding roller 1 is higher than the peripheral speed of the latter, the pinching of the wed material between the core A2 and the surface of the first winding roller 1 causes a tearing of the web material N between the area of contact with the core A2 and the area of tangency to the just completed log R. The insertion means 11 is suitably synchronized with the motion of the web material and of the perforating rollers 21, 25 so that tearing of the web material will take place always along a perforation line. This is achieved by the central unit 59 which always ensures the presence of a perforation line between the incoming new core and the formed log. In this way, there is ensured, not only a neat and precise tear, but also a constant number of perforations on each log R.

A deceleration of the second winding roller 3 causes, at this point, (in combination to the acceleration of the third roller 7) the discharge of the formed log R onto the surface 33. This deceleration also causes the core A2 to move out of the nip 5 and into the winding space 9 above the winding rollers 1 and 3, whereupon the web material winds onto the core to form a new log.

The leading edge of the web material generated by the tear is anchored to the core A2 by a longitudinal strip of glue. FIG. 5 shows the initial stage of the winding of a new log R2 on the core A2, while the insertion means 11 is rotated counterclockwise to move below the upper region of conveyor 13, from which said means 11 will pick up a subsequent core A3 to be inserted within nip 5 when the winding of the log R2 is completed. At this stage, the peripheral speeds of rollers 1, 3 and 7 are again substantially equal to the advancement speed of the wed material N.

To prevent the core in the process of being inserted into the nip 5 from coming in contact with the web material N before the moment in which contact is actually desired, a surface 18 is provided (shown in FIG. 2 and omitted in the other figures), which is disposed between the web material N and the trajectory of the core A, upstream of nip 5.

It is understood that the drawing shows an exemplification given only as a practical demonstration of the invention, as this may vary in the forms and dispositions without nevertheless coming out from the scope of the idea on which the same invention is based. The possible presence of reference numbers in the appended claims has the purpose to facilitate the reading of the claims, reference being made to the description and the drawing, and does not limit the scope of the protection represented by the claims.

Having thus described the invention, what is claimed as new and desired to protect by Letters Patent are the following:

1. Method for the formation of logs or rolls of web material, comprising the steps of:

providing a first winding roller;

providing a second winding roller, said first and said second winding rollers defining a nip therebetween;

providing a third winding roller, having a movable axis, said first, second and third winding rollers defining a winding space;

feeding a web material through said nip, said web material being in contact with said first winding roller;

winding said web material on a core to form a log within said winding space;

at the end of the winding of a log, before inserting a new core into said nip, temporarily accelerating said third roller (7) to increase the tensioning of the web material in the region of contact of said web material with said first roller and to locally increase the linear speed of said web material with respect to the peripheral speed of said first roller;

after the tensioning and the linear speed of the web material have been increased, bringing a new core in contact with the web material, said web material being pinched between said core and the first winding roller, and the pinched web material being torn between the formed log and the pinch point.

2. Method according to claim 1 including bringing the web material (N) into contact with the first winding roller, around which it is moved, through an angle smaller than 90 degrees.

3. Method according to claim 1 including perforating the web material along spaced transversal perforation lines and controlling the web so that the tear of the web material occurs along one of said perforation lines.

4. Method according to one of claims 1, 2 or 3 wherein the web material is caused to follow a free path upstream of the winding roller around which it is moved, and the tension induced by the acceleration of the third roller is distributed along said path.

5. Method according to one of claims 1, 2 or 3 wherein the third roller is accelerated to cause the discharge of the formed log onto a removal surface.

6. A machine for the production of rolls or logs (R) of web material (N) including:

a first winding roller (1) and a second winding roller (3) defining a nip (5) into which cores are inserted and through which the web material to be wound is made to pass, a third roller (7) defining, together with the two winding rollers, a winding space (9) for a log, insertion means (11) for inserting the cores (A) into said nip (5), means to keep the web in contact with one of said winding rollers, and means (59–69) to change the peripheral speed of said third roller (7) at the end of the winding of a log, said means (59–69) for changing the peripheral speed of said third roller (7) causing, at the end of the winding of each log (R), a tensioning and a local acceleration of the web (N) in the region between where the web is in contact with one (1)

of said winding rollers and where the web is in contact with the third roller (7), before insertion of a new core, said insertion means (11) being controlled to push a new core into the nip (5) after acceleration of the third roller (7) has begun, means to bring a new core into contact with the web material after the tension of the web has been increased whereby to pinch said web material between said core and the first winding roller so as to tear the web material between the formed log and the pinched point.

7. Machine according to claim 6 wherein the means to change the peripheral speed of said third roller includes an epicyclic gearing (61) and a correcting motor (69) connected to said epicyclic gearing, and a control unit (59) for controlling said correcting motor.

8. Machine according to claim 6 including a cylinder (31) arranged upstream of said winding rollers (1, 3) for the advancement of the web material therearound, said cylinder being spaced from said winding rollers to define a sufficiently long free path for the web material whereby the tension induced in the free part of said web material by the acceleration of the third roller (7) will be distributed therealong without tearing the web before insertion of a new core.

9. Machine according to claim 8 wherein the said cylinder (31) is disposed with respect to the winding roller (1) so that the web material makes contact with said winding roller (1) over less than 90 degrees of the winding roll surface.

10. Machine according to claim 6 including a perforating group (21, 23) to carry out perforations of the web material along transversal tear lines, and including means for cyclically accelerating the speed of the third roller (7) in synchronism with said perforating group to achieve the tearing of the web material along a perforation line.

* * * * *